United States Patent [19]

Yokoyama

[11] Patent Number: 4,502,790

[45] Date of Patent: Mar. 5, 1985

[54] ELECTRONIC TIMEPIECE

[75] Inventor: Hiroyuki Yokoyama, Suwa, Japan

[73] Assignee: Kabushiki Kaisha Suwa Seikosha, Tokyo, Japan

[21] Appl. No.: 231,080

[22] Filed: Feb. 3, 1981

Related U.S. Application Data

[63] Continuation-in-part of Ser. No. 932,588, Aug. 10, 1978, abandoned.

[30] Foreign Application Priority Data

Aug. 10, 1977 [JP] Japan ..... 52-96366

[51] Int. Cl.[3] ..... G04B 17/12; G04B 17/20

[52] U.S. Cl. ..... 368/200; 368/202

[58] Field of Search ..... 368/10, 21, 28, 29, 368/72, 73, 82–84, 155–156, 200–202, 250–251; 364/705, 710; 331/175, 176, 1, 2 R

[56] References Cited

U.S. PATENT DOCUMENTS

| | | | |
|---|---|---|---|
| 4,015,208 | 3/1977 | Hammer et al. | 368/202 |
| 4,063,409 | 12/1977 | Bayliss | 368/155 |
| 4,093,992 | 6/1978 | Kawamura et al. | 368/10 |
| 4,148,184 | 4/1979 | Akahane et al. | 368/202 |
| 4,158,285 | 6/1979 | Heinsen et al. | 368/10 |
| 4,217,653 | 8/1980 | Nakata | 368/21 |
| 4,218,876 | 8/1980 | Hashimoto et al. | 368/10 |
| 4,272,840 | 6/1981 | Morozumi et al. | 368/202 |
| 4,330,840 | 5/1982 | Kobayashi | 368/10 |

*Primary Examiner*—Vit W. Miska

*Attorney, Agent, or Firm*—Blum Kaplan Friedman Silberman & Beran

[57] ABSTRACT

Time sharing of a processor in a timepiece allows for performance without interference of a plurality of functions including timekeeping and supplemental functions. An electronic timepiece includes an oscillator for producing a time-standard high frequency signal, temperature detecting means, the processing unit, a display means and at least one dedicated memory for compensating for the effect of temperature on the frequency of the oscillator. In addition, memories are provided for compensating for the aging characteristics of the oscillator and the temperature-detecting means. Manually-actuatable input switches provide for carrying out changes in the temperature-compensating data as the oscillator and the temperature-detecting means age. These switches also make it possible to use the circuitry for calculation. Preferably, the frequency generated by the oscillator is an integer multiple of 10 Hz and dividers are provided for dividing the frequency down to 0.1 Hz which serves as the basic frequency for operation of said timepiece for displaying time, a perpetual calendar, a calculator and as an alarm.

16 Claims, 7 Drawing Figures

FIG. 6
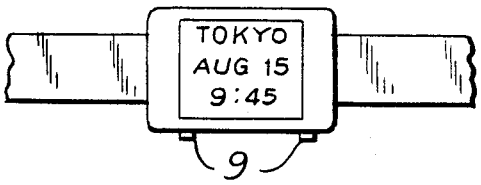
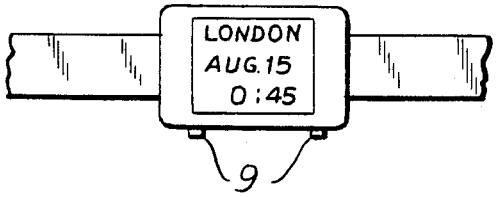
FIG. 7

ELECTRONIC TIMEPIECE

BACKGROUND OF THE INVENTION

In an electronic timepiece of high accuracy, a quartz crystal oscillator is generally employed as a time-standard signal generator. As is well known, the frequency generated by the quartz crystal oscillator changes with ambient temperature. Accordingly, in order to maintain the high accuracy of such an electronic timepiece, it is necessary to compensate for the change in the oscillation frequency of the quartz crystal oscillator or to adjust the divider frequency. Conventionally, the frequency has been compensated for temperature variations by providing in the quartz crystal oscillating circuit a capacitance element which is sensitive to temperature or by the use of a similar circuit element. The temperature characteristic of the circuit element thus compensates for the frequency-temperature characteristic of the quartz crystal oscillator. However, for this arrangement to be effective, the temperature-frequency characteristic of the quartz crystal oscillator must be exactly opposite to that of the added circuit element. As is evident, it is difficult to find a circuit element which will exactly compensate for the frequency-temperature characteristic curve of the quartz crystal oscillator. Moreover, the temperature-frequency characteristic curve of both the oscillator and of the compensation element change with time so that even if a circuit element having the desired properties were available, the process of aging would seriously degrade the accuracy of the combination.

In my Japanese Patent Application No. 81375/76 filed in Japan on July 7, 1976, and also filed in the United States on July 7, 1977, U.S. Ser. No. 813,732, (now U.S. Pat. No. 4,142,360, issued Mar. 6, 1979) I have described a temperature compensating device comprising a first oscillator for generating time standard signals and a second oscillator for detecting the temperature, the second oscillator having a different temperature characteristic from that of the first oscillator. The combination of the two oscillators makes it possible to determine the ambient temperature and to effect temperature compensation during frequency division. While effective, this construction suffers from difficulties in combining quartz crystal oscillators, and, particularly, with respect to aging.

As is evident, it would be desirable to provide circuitry for an electronic timepiece wherein the frequency is kept stable over long periods of time despite changes in ambient temperature and wherein timing adjustment can readily be effected both at the time of manufacturing and during repair of the timepiece.

A further point to be taken into consideration is that in conventional multi-functional timepieces, when it is desired to increase the number of functions which the timepiece can carry out, circuits must be redesigned, so that whenever product models are changed and new models are developed, a substantial expense both in time and costs must be paid. Moreover, where the display means for such a timepiece is of the seqment type, the number of multiple functions which can be displayed is severely limited.

What is needed is an electronic timepiece which can be adapted to perform many supplemental functions without redesign of the basic circuits.

SUMMARY OF THE INVENTION

A timepiece in accordance with the present invention includes an oscillator means for supplying a time-standard signal, a display means for displaying time as well as other data, processing means operating on a time-sharing basis for converting said time-standard signal into a time display signal for driving the display means. The timepiece also includes a read-only memory (ROM) for storing data, at least one manually-actuatable input switch means for selective input of data to the processing means, and a power source for powering the timepiece and its circuitry. In one embodiment the input switches are operably connected with the ROM and with the processing means on a shared time basis for input of time-correction signals.

In a second embodiment, the display means is of the matrix display type and, preferably, the ROM is constructed for storing a perpetual calendar and supplying calendar data to the processing unit on a shared time basis, and then to the matrix display means. The ROM may also store place names such as key cities and time differences for selective display of these names and their local time on the matrix display.

The oscillator means may produce a signal which is an integer multiple of 10 Hz and the processor means includes dividers for dividing the signal frequency down to 0.1 Hz time units.

Preferably, the electronic timepiece using a time-shared processor is of the multi-function type, one of the functions being an alarm means which can be set by using the manually-actuatable input switches to store alarm time data in a memory. In addition, the manually-actuatable input switches can be constructed for operating the timepiece circuitry as a calculator, and for supplying data for correcting the temperature-compensating means to take account of aging of the oscillator means and the temperature-detecting means. The processing means, as stated above, may be adapted for performance of selected functions in each of a plurality of portions of a selected interval of time. That is, the processing means operates on a time sharing basis with a fixed portion of time devoted to each function.

Preferably, the electronic timepiece includes a read-only memory, a programmable read-only memory and a random access memory cooperating with the processing means, whereby any desired function capacity can be incorporated in the timepiece by being pre-programmed in the memories. Data for operation or correction can also be inputted by means of the manually-actuatable input switches.

Accordingly, an object of the present invention is an electronic timepiece which applies basic circuits operating on a time-sharing basis to perform a wide diversity of programed functions including timekeeping and supplemental functions.

Yet another object of the present invention is an electronic timepiece of high accuracy including compensation for change in ambient temperature.

Still another object of the present invention is an electronic timepiece of high accuracy providing for change in temperature-compensation means with age and including a read-only memory which stores data to be inserted into a programmable read-only memory periodically to compensate for change in temperature characteristic with age.

A further object of the present invention is an electronic timepiece of high accuracy utilizing a matrix display system which can display characters in addition to numerical digits.

An important object of the present invention is an electronic timepiece of high accuracy which is multifunctional, an alarm function and a perpetual calendar function being included.

A significant object of the present invention is an electronic timepiece of high accuracy having a sufficient number of manually-actuatable input switches and circuitry such that said timepiece can be used as a calculator.

Still other objects and advantages of the invention will in part be obvious and will in part be apparent from the specification.

The invention accordingly comprises an article of manufacture possessing the features, properties, and the relation of elements which will be exemplified in the article hereinafter described, and the scope of the invention will be indicated in the claims.

BRIEF DESCRIPTION OF THE DRAWINGS

For a fuller understanding of the invention, reference is had to the following description taken in connection with the accompanying drawings, in which:

FIGS. 6 and 7 show time displays by a matrix display panel in an embodiment of the present invention.

DETAILED DESCRIPTION OF THE PREFERRED EMBODIMENTS

Figure 1:
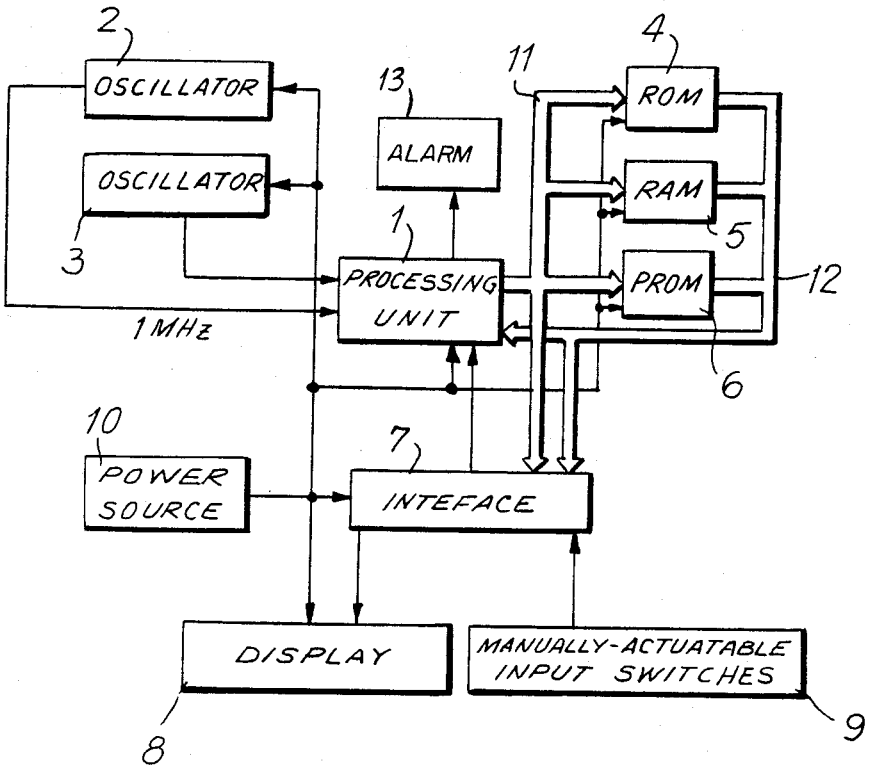
FIG. 1 is a block diagram of a timepiece in accordance with the present invention.

Referring to FIG. 1, a processing unit 1 includes registers, accumulators, decoders, counters, dividers and the like conventional circuit elements as required for performing one or more of a plurlaity of functions as described more fully below. The processing unit is preferably formed of C-MOS circuits for low power consumption. A quartz crystal oscillator 2 generates time standard signals of high frequency, the oscillation frequency thereof, preferably being an integer multiple of 10 Hz. Such a frequency is convenient for obtaining a signal having a frequency of 0.1 Hz which is used, as an example, as the basic time unit of the timepiece in accordance with this invention. Conveniently, the oscillation frequency may be 1,000,000 Hz (1 MHz).

Comparing such an oscillator with a conventional chronograph watch, the conventional chronograph obtains a one second signal by dividing a time standard signal of 32,768 Hz in half, successively, fifteen times, and where a 0.1 second signal is desired, this is obtained by dividing the 16 Hz signal obtained during the division. As is evident, such a method is essentially inefficient and subject to an error. In contrast, in accordance with the present invention, where a signal of 10 Hz is obtained by generating a time standard signal which is an integral multiple of 10 Hz, it is possible to obtain an exact 0.1 second signal readily and without error.

There is a multitude of supplemental functions which can be performed by a timepiece having a processing unit 1 and the primary timekeeping function and display. The embodiment of FIG. 1 is selected as exemplary, and for this illustration, time correction of the time standard signals from the quartz crystal oscillator 2 is a supplemental function; an alarm is indicated as a supplemental function; and manually actuatable input switches 9 are included to activate internal supplemental functions, or for performing another supplemental function such as calculations. As explained more fully hereinafter, a plurality of memories, namely, ROM 4, RAM 5, and PROM 6, cooperate with the processing unit 1 to perform pre-programmed functions and the switches 9, through an interface 7, have access to the data in memory. The display 8, a conventional liquid crystal display, receives data for display through the interface 7. Such data includes timekeeping data as well as supplemental function data, for example, calculation inputs from the switches 9 and computed products.

Figure 3:
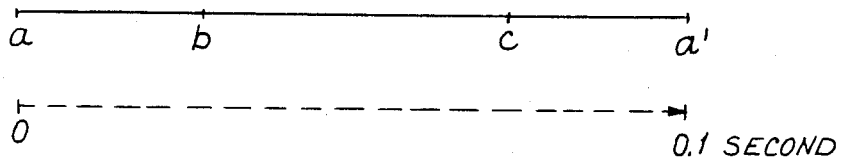
FIG. 3 shows schematically the time sharing of a basis time interval in which the operation of the present invention is performed.

In order to carry out the multiple functions of the timepiece, time sharing of the operations is utilized. The present electronic watch facilitates this procedure. Referring to FIG. 1, processing unit 1 is driven by a time-standard pulse of high frequency generated by the time-standard oscillator 2. However, the processing unit 1 carries out each individual function in a period which is substantially shorter than the basic 0.1 second time unit, so that the various functions, i.e., calculations, corrections, etc., may be carried out without interfering with time signals or each other. More specifically, at the time represented by the character a' in FIG. 3, the timekeeping operation is completed and processing unit 1 transfers all time-measuring operations to be stored to the RAM 5 or to registers inside the processing unit 1 itself. Then a supplemental function is performed. For example, in an alarm type timepiece, data such as alarm data (date, hour, minute) which have been previously set by the user by means of switches 9, and stored in memory, are read from the RAM 5 and compared with the data for time measurement which have been stored and are updated regularly during the period c-a' (FIG. 3). When those data are coincident with each other, at the time indicated by the character b, the display portion generates an alarm, or a buzzer 13 or other alarm is activated. In the time period b-c other than period a-b during which an alarm function is to be activated, any other function which the user has previously selected and inputted data therefor, may be put into operation. Where the user has not selected any other function in advance, the processing unit 1 remains quiescent and waits during the period which extends from b to c (FIG. 3). If, for example, the timepiece includes an electronic calculator having an external keyboard (buttons), calculations would be performed in the period b-c. It should be understood that all functions, primary, that is timekeeping, and supplemental are performed in their assigned time slot even though only one function, for example, calculations, may be displayed over an extended period. Obviously, timekeeping must be continued internally to maintain the accuracy of the timepiece.

Bus 11 is an address bus for effecting reading of the various memories under the control of processing unit 1. Bus 12 is a data bus for transmitting data between the memories and to the processing unit 1.

Figure 2:
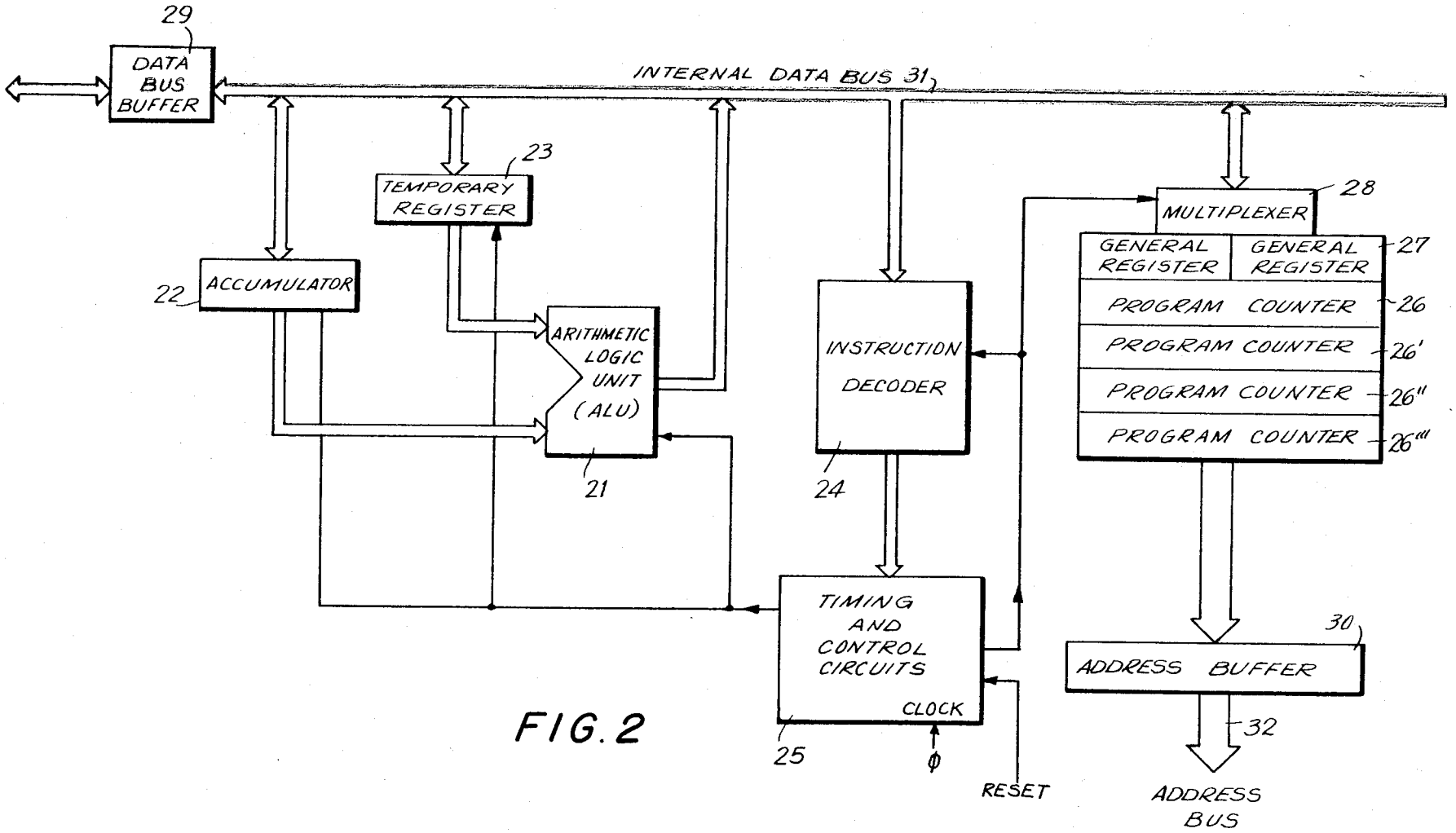
FIG. 2 is a more detailed block diagram of a portion of FIG. 1 including a processing unit.

The central processing unit 1 of FIG. 1 is shown in more detail in FIG. 2. The central processing unit 1 comprises an instruction decoder 24, timing and control circuits 25, an arithmetic logic unit 21, address buffer 30, data bus buffer 29, multiplexer 28, general registers 27 and a plurality of program counters 26, 26', 26'', 26'''.

Also included are internal data bus 31 and an address bus 32. The data buses 11, 12 of FIG. 1 connect with the data bus buffer 29. The processing unit 1 also includes an accumulator 22 and temporary register 23.

The instruction decoder 24 receives a command code signal from one of the memories by way of the internal data bus 31. The command code signals are provided with appropriate timing and the decoded signal is imputted to the timing and control circuits 25 which output timing signals to actuate other elements. An external clock signal $\phi$ is inputted to the timing and control circuit 25 which in response to the instructions from the decoder 24 controls the other functions. For example, the arithmetic logic unit is instructed to perform logical operations, that is, addition and substraction, bit shift operation, etc. The accumulator 22 is instructed to supply a first operand to the arithmetic logic unit 21. The temporary register 23 is instructed to supply the second operand to the arithmetic logic unit 21, and general registers 27 are directed to store interim results. The program counters 26-26''' advance and indicate addresses in the memories 4, 5, 6 (FIG. 1) in a programmed sequence.

The arithmetic logic unit 21 is comprised of an adder and shift register, and performs various operations in accordance with the instructions from the instruction decoder 24 which arrive by way of the timing and control circuits 25. The timing and control circuits 25 include a plurality of dividers and produce timing signals to instruct each element how to operate and in what state with respect to the clock signal $\phi$. In particular, the timing and control 25 in accordance with this embodiment produces three independent timing signals within the standard time unit of 0.1 seconds for time sharing.

As is well known, the operation of processing means 1 or micro-processor, consists of repeatedly accessing instructions from external memories, that is, in the illustrative embodiment, memories 4, 5, 6, and executing the operations specified by these instructions. Thus, the processing unit 1 accesses data stored in the memories 4, 5, 6 by way of the address buffer 30 and address bus 32. Bus 32 of FIG. 2 connects with bus 11 of FIG. 1. Data bus 12 (FIG. 1) is a two-way data bus used in reading data from the memories 4, 5, 6 and also for writing data into the ram 5.

Thus, the processing means 1 accesses data stored in the memories 4, 5, 6 and in accordance with a program stored in said memory performs operations as required in the arithmetic logic unit 21 or elsewhere. The processing unit 1 performs the timekeeping operations and feeds the data from the RAM 5 or internal registers, for example, register 27, and at the appropriate time in the time sharing process feeds the data of timekeeping from memory to the display 8. As explained more fully hereinafter, the processing unit 1 also can receive data from the manually actuatable input switches 9 and this data is used operatively with stored programs accessed in the external memories 4, 5, 6. By the selection of proper memory addresses it is possible to perform any of the functions which are programmed in the memories including timekeeping, comparison of the frequency of the oscillators 2, 3, computations using data inputted by the manual switches 9, presenting perpetual calendar data which has been previously stored in memory, accessing aging data from memory, and so on. The processing unit 1 divides the standard time signal from the oscillator 2 internally into a selected standard unit of time and further sub-divides the standard unit of time into portions which are assigned to the repetitive performance in each portion of an individual function. Thus, the time is shared between the functions on a regular basis.

Continuing with the example presented above, and with reference to FIG. 3, by means of a first timing signal, the seconds, minutes, hours, date, day, month and year are respectively counted once in each standard unit of time. In this timekeeping function, corrections can be included relying on data stored in a given portion of the RAM 5 and accessed in accordance with a command to the proper memory address directed, for example, from the first program counter 26. The timekeeping data is delivered to the display 8 and also is stored in a given portion of the RAM 5. Such operations are performed, in this example, in the periods from c to a' of FIG. 3.

Then, a second timing signal occurring within the standard unit of time resets the first program counter 26 to its original values and a second program counter 26' indicates an address for another portion in the ROM 4. This address is transmitted through the address buffer 30 and address bus 32 to the ROM 4. As stated above, bus 11 of FIG. 1 is included in address bus 32 of FIG. 2. For example, the addressed portion of memory ROM 4 includes a program for an alarm operation. Alarm time data is read out of RAM 5 and stored in the accumulator 22 after passing through the data bus buffer 29. Similarly, present time data, which as stated above is accumulated in selected addresses of memory RAM 5, is inputted to the temporary register 23. These data in the accumulator 22 and temporary register 23 are substracted in the arithmetic logic unit 21 in accordance with instructions from the decoder 24 and timing and control circuits 25. The result of the substraction in the arithmetic logic unit 21 is returned to the accumulator 22. When the difference between the data returned to the accumulator 22 is not equal to zero, that is, when the alarm time does not coincide with the present time, there is no alarm signal in the period of FIG. 3 from a to b.

Figure 4:
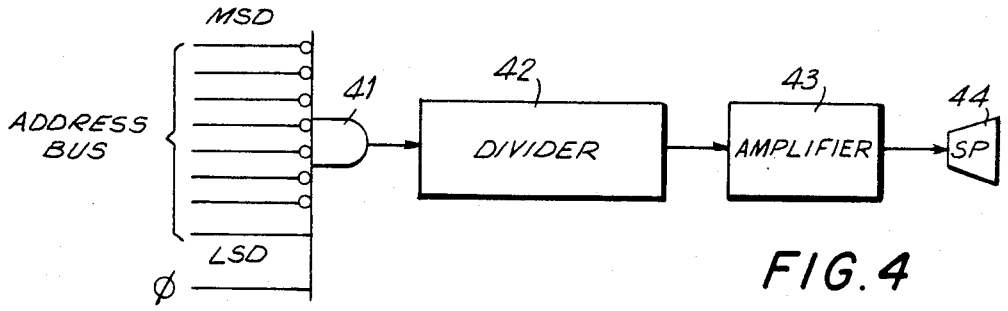
FIGS. 4 and 5 show circuits for supplemental functions of FIG. 1.

However, when the difference in the data signals returned from the arithmetic logic unit 21 to the accumulator 22 is in fact zero, that is, the alarm time which had been stored in the memory RAM 5 coincides with the present time, an alarm is actuated during the period a-b. In particular, when the result is zero, a signal is delivered by means of the internal data bus 31 which causes an address ignal to be selected and outputted on the address bus 32. This actuates an alarm function as follows. FIG. 4 shows an exemplary alarm function which comprises an address input gate 41, a divider 42, amplifier 43 and loud speaker 44. A clock signal $\phi$ derived from the oscillator 2 can pass through the gate 41 only when the gate is properly addressed. In FIG. 4, only when 00000001 in binary code is delivered on the address bus can the signal $\phi$ pass through gate 41. This address is selected from a program counter in the processing unit when, as stated, the selected alarm time data matches the present time data. When properly addressed, the high frequency clock signal from the oscillator 2 passes through gate 41 and is divided down into an audio frequency range, for example, 1 KHZ by the divider 42. Then the audio frequency signal is amplified by the amplifier 43 before actuating the speaker 44 with a 1 KHZ signal. The alarm sound is emitted for a period from a to b (FIG. 3) by comparing only hour and minute data of the selected alarm time with the present time. Thus, for one minute of the present time, the data will match and the alarm sound will persist for a minute. This sound seems continuous to the ear because the time sharing is based upon a 0.1 second standard time unit and the sound repeats ten times per second at 1 KHZ.

When the third timing signal is produced at time b during the standard time unit of 0.1 seconds, the second program counter 26' is reset to its original value and then the third program counter 26'' is actuated. During this time, another supplemental function can be performed. In this example, it is assumed that the supplemental function is the operation of the timepiece as a calculator using the manually actuatable input switches 9. Operations of the calculator are performed in the time period from b to c. If the manually actuatable input switches 9 are not actuated, then this period b-c is a quiescent period.

Figure 5:
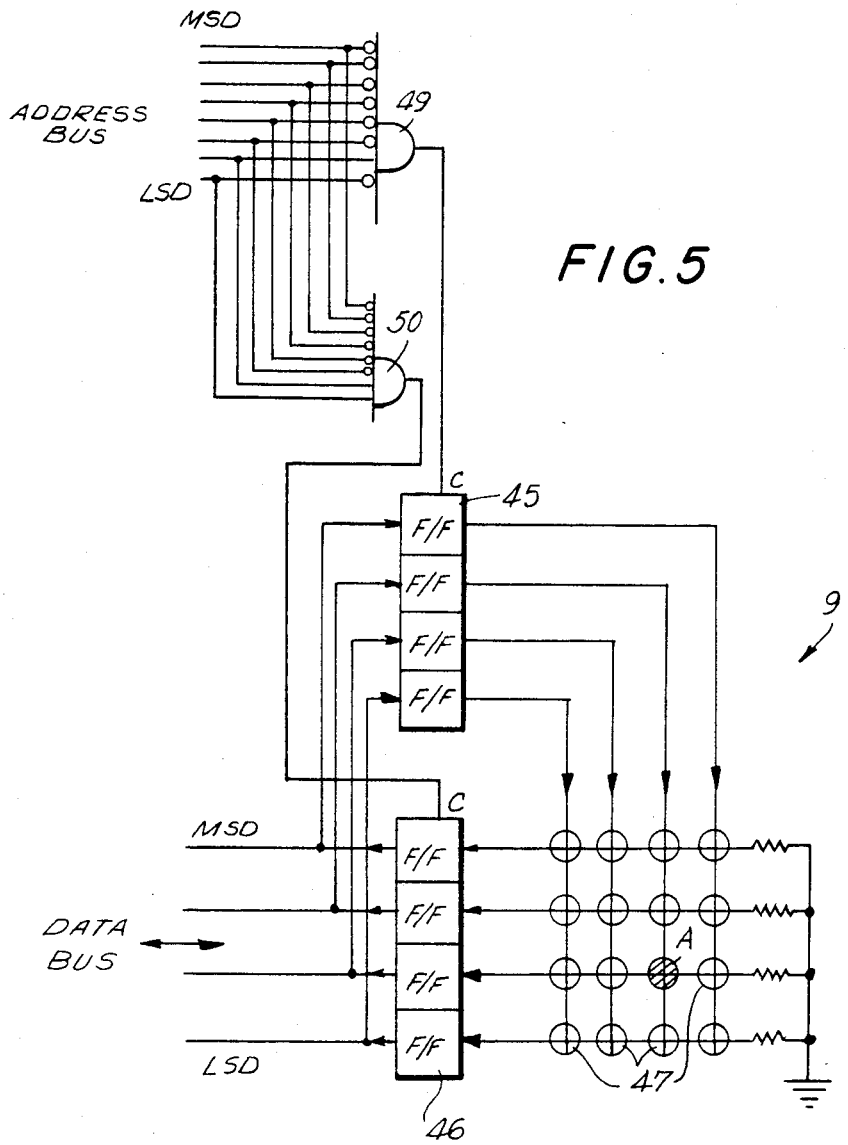

FIG. 5 is an exemplary input circuit for a calculator function in a timepiece. The input circuit includes the manually actuatable input switches 9 having external buttons 47, a pair of address circuits 49, 50, and flip-flop rows or latches 45, 46. A two-way data bus connects to the input of the flip-flop row 45 and to the output of flip-flop row 46. However, it should be noted that a data signal inputted to a flip-flip row passes to the output of that flip-flop row only when the row is clocked. Clocking of flip-flop rows 45, 46 is controlled by the address circuits 49, 50 respectively such that only one flip-flop row at a time can be inputted with new data.

During the period b-c (FIG. 3) the program counters output address signals through the address buffer 30 and address bus 32 which are applied to the address circuits 49, 50. As shown in FIG. 5, when the central processing unit 1 delivers a signal 0001 in binary code to the data bus and subsequently the address bus indicates 02 (hexadecimalized code), that is, 00000010 , the flip-flop row 45 is enabled to receive and hold the data signal 0001. Then, the address bus carries a signal from the processing unit 1 indicating 03, that is, 00000011, and the output of the address circuit 50 goes high to enable the flip-flop row 46 to receive data from the flip-flop row 45. The processing unit 1 now reads the state of the flip-flop row 46 and thereby the processing unit 1 has the information about which button 47 has been pushed. It should be understood that there is no connection between the output of flip-flop row 45 and the inputs to flip-flop 46 unless a button 47 is pushed. Until a button 47 is pushed, the inputs to every stage of flip-flop row 46 is at ground potential and the outputs read on the data bus would be 0000. When a button 47 is pushed, the output of the connected stage of flip-flop row 45 is inputted to the connected stage of flip-flop row 46.

For example, assume that button A of FIG. 5 is pushed during the period b-c (FIG. 3). When the processing unit 1 delivers 0100 on the data bus, this data is inputted to the flip-flop row 45 and latched when the address circuit 49 goes high at its output. Then the address circuit 49 goes low at its output and the address circuit 50 goes high at its output. The depressed button A is connected to the flip-flop stage in flip-flop row 45 which has a high output, and accordingly, that high is received in the one stage of flip-flop row 46 also connected by the depressed button A. Accordingly, at the output of the flip-flop row 46 appears the data signal 0010, which is put on the data bus and inputted to the processing unit through the data bus buffer 29 and internal data bus 31 (FIG. 2). It should be noted that only when the signal 0100 first appears on the data bus as an input and when the button A is depressed does the signal 0010 appear at the output of flip-flop row 46 for input to the processing unit 1. In this way, the processing unit can identify that button A has been depressed as part of the calculation procedure. The signals inputted to flip-flop 45 from the data bus rapidly scan and in sequence make each flip-flop stage of flip-flop 45 have a high output. Accordingly, there is a combination of input data and output data which identifies the depression of each button 47 individually. Thus, the processing unit 1 easily identifies which button of the many buttons 47 is pushed. Calculation is possible in a conventional electronic calculator technique by means of the processing unit 1 receiving instructions from the buttons 47. Arithmetic operations associated with particular buttons are also programmed in the ROM or PROM. It should be understood that the calculation data, as inputted, can be brought to display, temporarily displacing or sharing space with the timekeeping display.

Functions which can be performed by a timepiece having a processing unit 1 with little change in the basic circuit design are now described.

For purposes of temperature compensation, the quartz crystal oscillator 3 also provides time standard signals. However, the temperature-frequency characteristic of the quartz crystal oscillator 3 is selected to be different from that of the principal oscillator 2. The processing unit 1 receives time standard signals from the quartz crystal oscillator 3, and generates a signal representative of the temperature, derived from the difference in the time standard signals supplied by the two oscillators.

Processing unit 1 is connected with the programmable read-only memory (PROM) 6 for reading the data stored therein and making a temperature compensation correction in the timekeeping on the basis of the stored data. The data stored in PROM 6 is incorporated therein at the time of manufacture and provides the amount of compensation required at each operating temperature based upon the temperature-frequency characteristic of the quartz cyrstal oscillator 2. Processing unit 1 modifies the time standard signal during the division thereof in accordance with the data for temperature compensation so as to eliminate the effects of change in ambient temperature, and then produces 0.1 second signals of greater accuracy. Such modification of timekeeping can be by way of pulse inclusion or elimination using known correction techniques. The low frequency time-keeping signals provided by the corrected division are accumlated individually in 0.1 second steps from 0 to a total of 9 in a register of the processing unit 1. The contents of the register are transmitted to the interface 7, and then to be displayed by display means 8 such as a liquid crystal display panel using a seven bar displays. Preferably, the display panel is of the matrix type. It should be understood that the display may be capable of presenting timekeeping data concurrently with other data, for example, calculation data. On the other hand, supplemental functions, e.g. calculations, when performed may preempt the display of timekeeping.

After the data in 0.1 second units accumulate one by one to a value of 9 in the register, the contents of the register are reset to 0. On the next 0.1 second unit the displayed figure of the seconds display ticks up one place. After the 0.1 seconds unit are added up to one second, the seconds are then added individually up to a total of 59 in another register. When the second signal totals 59 and the contents of the register are reset to 0 after an additional second, the figure for the minutes display is moved up one place. In the same way, seconds, minutes, hours, date, day, month and the year data are produced and displayed by display panel 8. Details of the display, time division and counting, are well known to those skilled in the art and need not be presented in further detail herein.

The correction of timekeeping accuracy can be programmed to occur in the period c-a' of FIG. 3 or elsewhere in the basic time unit, here as an example, 0.1 seconds. It should be understood that whereas the basic time unit is illustrated as broken into three time-sharing periods, the number of divisions may be greater or less depending upon the number of functions to be serviced in each time unit and the selected duration of the time unit.

A supplemental function using the external switches 9 is now described. As is known, the characteristics of quartz crystal oscillators change with age. The appropriate data for correction for aging may be stored in ROM 4 at the time of manufacture and may be entered into random access memory 5 (RAM) by operation of one of the manually-actuatable input switches 9 through the interface 7. The data for temperature compensation may thereby be changed in RAM 5 from the original data stored in PROM 6 in accord with the data from ROM 4. By this means, suitable temperature adjustment can readily be made, taking account of both aging and the temperature-frequency characteristic. The data for temperature compensation may be corrected approximately once a year either automatically or by actuation of a switch 9. As a result of which the effect of aging on the accuracy of the timepiece can be minimized.

As another example, pairs of place name codes and time differences may be incorporated in ROM 4. This makes it possible to display the name of a place, for example a major city, and the time in that city in a matrix display means. The processing unit 1 operates according to the place name code generated externally by operation of the input switches 9. To effect such a matrix display, n x m bits of data are necessary, the matrix consisting of n lines in length and m lines in width. Such a matrix display makes it possible to display far more data than can be displayed by the usual segmental digital display. With such a matrix construction, it is extremely easy to make use of the surplus capacity in the timepiece, especially the capacity of the processing unit 1. This is the advantage in using a processing unit with memories which are programmed in use or in manufacture rather than using conventional hard logic. Moreover, with a matrix display it is possible to present letters and designs in addition to numbers. Therefore, an electronic timepiece in accordance with the present invention can easily be used for generating displays as shown in FIGS. 6 and 7 where both the name of a place and the time (date, hour, minute) at that place can be shown.

A further function readily obtainable with the construction shown in FIG. 1 is that of a perpetual calendar. Thus, taking note of the fac that: February has 28 days in years which are not a multiple of four and also in years which are a multiple of one hundred; twenty-nine days in other years which are a multiple of four; January, March, July, August, October and December have thirty-one days; and the remaining months have thirty days, a perpetual calendar in the true sense of the word can readily be established. If these data are incorporated into a program by hard logic, it is inefficient and difficult to combine them in a timepiece; however, a completely automatic perpetual calendar mechanism which is simple and easy to use can be realized by employing a microprocessor of the present invention. In addition, the power which must be supplied by the power source 10 is minimal.

In accordance with the present invention, since all functions are carried out with time sharing, as the time proceeds, for example, from a to b to c to a' and then back to a (FIG. 3), immediately after each function is completed, any kind of data in a register of processing unit 1 may be stored in RAM 5 or in another special register in microprocessor 1 which is unemployed or not affected during another function, and then the next operation may be started. In this way, multiple functions are performed, passing through a to a' and returning to a. The multiple functions as detailed here are incorporated into the program by software. Thus, other functions than those already recited can be effected by a simple change in the program. Accordingly, where a model change in a timepiece is to be effected, circuits need not be changed in design, or, where such change is necessary, the change is minimal so that time and cost of development are minimal. Moreover, since the time-measuring action can be programmed in such a manner that the basic time unit starting from a and returning to a is equal to 0.1 seconds, the timepiece in accordance with the present invention can display the time with great precision. Moreover, the present invention can be applied to a clock, a wristwatch, and to a calculator.

It will thus be seen that the objects set forth above, among those made apparent from the preceding description, are efficiently attained and, since certain changes may be made in the above constructions without departing from the spririt and scope of the invention, it is intended that all matter contained in the above descripition or shown in the accompanying drawings shall be interpreted as illustrative and not in a limiting sense.

It is also to be understood that the following claims are intended to cover all of the generic and specific features of the invention herein described and all statements of the scope of the invention which, as a matter of langugage, might be said to fall therebetween.

What is claimed is:

1. An electronic timepiece comprising oscillator means for supplying a time-standard signal; display means for displaying at least time; processing means for converting said time-standard signal into a time display signal for driving said display means; temperature-detecting means connected with said processing means for conveying a signal representative of temperature to said processing means; memory means coupled to said processing means and storing data representative of the amount of time correction required for each temperature, said processing means being adapted to effect correction of said time standard signal for temperature-induced errors to produce a corrected time display signal, and further memory means storing further data representative of time correction due to aging of said oscillator means, said processing means being adapted to selectively modify said first-mentioned data in said first-mentioned memory means by said further data, the amount of said time correction being at least in part determined by said data stored in said first-mentioned memory means.

2. The electronic timepiece of claim 1, wherein said first-mentioned memory means is a programmable read-only memory (PROM) and said second memory is a read-only memory (ROM), and further including a random access memory (RAM), said processing means being adapted to initially effect correction in response to said first-mentioned data stored in said PROM and to thereafter, when correction due to aging is required, to store said further data in said RAM from said ROM and to effect modification of said first-mentioned data by said further data.

3. The electronic timepiece of claim 1, wherein said temperature-detecting means is a second oscillator means having a different temperature characteristic from that of said first-mentioned oscillator means, said processing means being adapted to produce said temperature signal from the difference in frequencies of signals produced by said first-mentioned and second oscillator means.

4. An electronic timepiece comprising oscillator means for supplying a high frequency time standard signal;

display means for displaying at least time; and processing means for dividing said high frequency time standard signal into relatively low frequency timekeeping signals for driving said display means and for performing a further function, said processing means being adapted to perform said timekeeping function during a first fixed portion of a selected unit of time, said selected unit of time being measured in the course of said dividing, and to perform said further function during a second fixed portion of said selected unit of time, at least said timekeeping function being performed repetitively in each selected unit of time, said further function being temperature-detecting means connected with said processing means for conveying a signal representative of temperature to said processing means; memory means coupled to said processing means and storing data representative of the amount of time correction required for each temperature, said processing means being adapted to effect correction of said time standard signal for temperature-induced errors to produce a corrected time display signal, and further memory means storing further data representative to time correction due to aging of said oscillator means, said processor means being adapted to selectively modify said first-mentioned data in said first-mentioned memory means by said further data, the amount of said time correction being at least in part determined by said data stored in said first-mentioned memory means.

5. The electronic timepiece as claimed in claim 4, wherein said first-mentioned memory means is a programmable read-only memory (PROM) and said second memory is a read-only memory (ROM), and further including a random access memory (RAM), said processing means being adapted to initially effect correction in response to said first-mentioned data stored in said PROM and to thereafter, when correction due to aging is required, to store said further data in said RAM from said ROM and to effect modification of said first-mentioned data by said further data.

6. The electronic timepiece as claimed in claim 4, wherein said temperature-detecting means is a second oscillator means having a different temperature characteristic from that of said first-mentioned oscillator means, said processing means being adapted to produce said temperature signal from the difference in frequencies of signals produced by said first-mentioned and second oscillator means.

7. The electronic timepiece as claimed in claim 4, said selected time unit being 0.1 seconds.

8. An electronic timepiece comprising oscillator means for supplying a high frequency time standard signal;

display means for displaying at least time; and processing means for dividing said high frequency time standard signal into relatively low frequency timekeeping signals for driving said display means and for performing at least one further function, said processing means being adapted to perform said timekeeping function during a first fixed portion of a selected unit of time, said selected unit of time being measured in the course of said dividing, and to perform said further function during a second fixed portion of said selected unit of time, at least said timekeeping function being performed repetitively in each selected unit of time, said further function being temperature-detecting means connected with said processing means for conveying a signal representative of temperature to said processing means; memory means coupled to said processing means and storing data representative of the amount of time correction required for each temperature, said processing means being adapted to effect correction of said time standard signal for temperature-induced error to produce a corrected time display signal, and further memory means storing further data representative to time correction of said oscillator means, said processing means being adapted to selectively modify said first-mentioned data in said first-mentioned memory means by said further data, the amount of said time correction being at least in part determined by said data stored in said first-mentioned memory means.

9. The electronic timepiece of claim 8, wherein said further functions include an alarm function, and including memory means, said processing means being adapted during said second portion of said selected unit of time to compare actual time with data representative of a selected alarm time stored in said memory means, and further including means for applying alarm time data to said memory means.

10. The electronic timepiece of claim 8, wherein said further functions include a calculator function, said timepiece including a plurality of manually operable switch means defining a calculator input, said processor means being adapted to perform calculator functions in response to said manually operated switch means and to a apply calculator display signals to said display means for the display of the results thereof during said second portion of said selected unit of time.

11. The electronic timepiece of claim 8, wherein said further functions include a global time display function, said timepiece including memory means storing data representative of the name and time at a plurality of locations and means for manually selecting the location to be displayed, said processing means being coupled to said memory means and said selection means for reading the selected data from said memory means and applying same to said display means for the display of said selected name and time, during said second portion of said selected unit of time.

12. The electronic timepiece of claim 8, wherein the processing means is adapted to perform a still further function, the period of said selected unit of time being divided into at least three portions, said time display functions being performed in said first portion, said further function being performed in said second portion and said still further function being performed in a third portion.

13. The electronic timepiece of claim 8, wherein said high frequency time standard signal is of a frequency equal to an integer multiple of 10 HZ.

14. The electronic timepiece as claimed in claim 8, wherein said first-mentioned memory means is a programmable read only memory (PROM) and said second memory is a read-only memory (ROM), and further including a random access memory (RAM), said processing means being adapted to initially effect correction in response to said first-mentioned data stored in said PROM and to thereafter, when further correction in the light of data from said ROM is required, to store said further data in said RAM from said ROM and to effect modification of said first-mentioned data by said further data.

15. The electronic timepiece as claimed in claim 8, wherein said temperature-detecting means is a second oscillator means having a different temperature characteristic from that of said first-mentioned oscillator means, said processing means being adapted to produce said temperature signal from the difference in frequencies of signals produced by said first-mentioned and second oscillator means.

16. The electronic timepiece as claimed in claim 8, wherein said selected time unit is 0.1 seconds.

* * * * *